United States Patent [19]

Kawada

[11] Patent Number: 4,830,147

[45] Date of Patent: May 16, 1989

[54] JACKING DEVICE

[75] Inventor: Hiroyuki Kawada, Hekinan, Japan

[73] Assignee: Sugiyasu Industries Co., Ltd., Japan

[21] Appl. No.: 151,171

[22] Filed: Feb. 1, 1988

[30] Foreign Application Priority Data

Mar. 4, 1987 [JP] Japan ..... 62-31288[U]

[51] Int. Cl.[4] ..... B66F 3/22

[52] U.S. Cl. ..... 187/8.62; 187/8.72; 254/122; 248/277

[58] Field of Search ..... 187/8.61, 8.62, 8.47, 187/8.72, 62, 63, 64, 18, 8.57; 254/122, 124; 74/521, 566; 182/69, 157, 148; 248/277, 421; 52/109, 111

[56] References Cited

U.S. PATENT DOCUMENTS

| | | | |
|---|---|---|---|
| 1,193,487 | 8/1916 | Preston | 74/566 X |
| 2,937,852 | 5/1960 | Clarke | 254/122 |
| 3,393,772 | 7/1968 | Pelouch | 187/8.62 X |
| 3,702,645 | 11/1972 | Shaw | 187/18 |
| 3,982,718 | 9/1976 | Folkenroth et al. | 248/421 |

*Primary Examiner*—Joseph J. Rolla
*Assistant Examiner*—Stephen B. Parker
*Attorney, Agent, or Firm*—Lahive & Cockfield

[57] ABSTRACT

A jacking device, which is, for example, used for lifting a motor vehicle when repairing it, includes at least one jack installed in a floor pit and including at least two horizontally spaced apart parallel pairs of links which are designed for simultaneous movement in two parallel vertical planes, respectively. A mechanism is associated with the links for moving them vertically. A table is horizontally supported on the links for lifting e.g. a motor vehicle. Each pair of links consists of a first link and a second link which are so connected to each other as to form an X-shaped assembly when they are raised to raise the table. The first links in those two pairs of links are parallel to each other, and the second links are also parallel to each other. The links and the link moving mechanism are foldable into the pit when the table is lowered to close the pit. Each of the second links has a lower end supported in the pit slidably along one of a pair of sidewalls of the pit, while each of the first links has a lower end supported rotatably in the pit at one end thereof. A horizontal pit cover is connected to the second links slidably therewith for closing the pit which is opened when the table is raised. A mechanism including a pair of slidable brackets connects the cover to the second links for allowing the cover to slide with the second links.

5 Claims, 3 Drawing Sheets

JACKING DEVICE

BACKGROUND OF THE INVENTION

1. Field of the Invention

This invention relates to a jacking device of the type which is generally known as a scissors jack.

2. Description of the Prior Art

There is known a jacking device which comprises a pair of vertically stretchable jack components lying in parallel to each other and each having a bottom supported in a floor pit, a mechanism associated with the jack components for stretching and folding them together, and a table supported on the jack components for carrying a cargo thereon. The jack components are foldable into the pit when the device is not used, and the table covers the pit when the jack components have been folded. The table is raised as the jack components are stretched.

The known device has a number of problems which occur as a result of the raising of the table. When the table is raised, it opens the pit. The pit is usually left open, or a separate cover is placed over the pit by the operator of the jacking device if he considers it necessary or desirable to ensure his safety during the jacking operation.

If the pit is left open, there is every likelihood that the operator may fall into the pit and get injured, or may drop a tool or anything else into the pit. If he forgets to pick up any tool or the like that he has dropped into the pit, it is very likely to cause some kind of trouble to the jacking device when the jack components have been folded. The use of a separate cover is an effective solution to any such problem, but the operator usually does not like to take the trouble to place the cover over the pit.

SUMMARY OF THE INVENTION

Under these circumstances, it is an object of this invention to provide an improved jacking device which can overcome any of the problems as hereinabove pointed out as occurring when the device is used for lifting a cargo or supporting it in a raised position.

This object is essentially attained by a jacking device including a pit cover which is automatically movable to open and close a floor pit.

This invention is an improvement in the jacking device including a pair of parallel jack components each defined by at least one X-shaped assembly of two links. One of the links forming one of the jack components and one of the links forming the other jack component lie in parallel to each other and are rotatably supported at the lower ends thereof in the pit at one end thereof. The other link forming one of the jack components and the other link forming the other jack component also lie in parallel to each other, but are supported at the lower ends thereof slidably along the pit. The pit cover is slidable along the pit with the sliding motion of the slidable links.

Each jack component may comprise either one or two X-shaped assemblies. The former type of jack component can be defined as a single X-shaped component, and the latter type as a double X-shaped component.

The slidable links are slidable for stretching or folding the jack components to thereby raise or lower a table supported thereon and carrying a cargo thereon. When the table is raised, the pit cover slides with the slidable links and thereby closes the pit which has been opened by the table leaving it. When, on the other hand, the table is lowered, the pit cover slides back to open the pit. When the table has been lowered to its lowermost position, the pit cover opens the pit completely and the table in turn closes the pit in which the jack components and the mechanism for driving them have been withdrawn.

The pit cover is automatically movable and does, therefore, not require any special mechanism when it is placed over the pit, or removed therefrom. The jacking device of this invention eliminates the necessity for any pit cover relying upon manpower when it is placed over the pit, or removed therefrom.

The pit cover keeps the pit closed as long as the table stays in its raised position. Therefore, nobody is likely to fall into the pit or drop a tool or the like into the pit. The jacking device of this invention is free from any trouble of the kind which would occur if any tool or the like had been dropped into the pit and had not been picked up.

Moreover, the jacking device is simple in construction, inexpensive, and substantially free from any operating fault. Therefore, it is a device of high industrial utility.

DETAILED DESCRIPTION OF THE INVENTION

Figure 1:
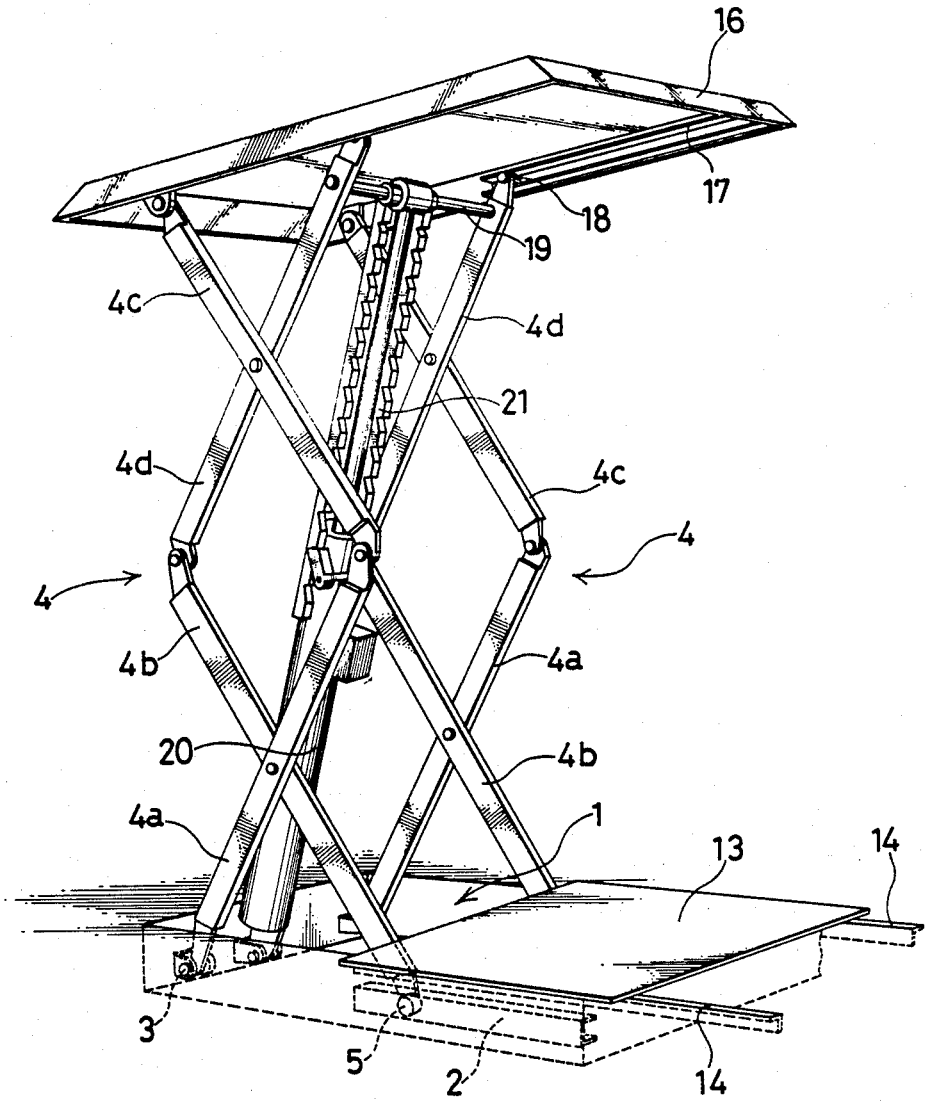
FIG. 1 is a perspective view of a jacking device embodying this invention.

A jacking device embodying this invention is shown by way of example in FIG. 1. It is a device which can be used for lifting a motor vehicle when repairing it. It comprises a pair of "scissors" jacks installed in a pair of parallel rectangular floor pits, respectively, and designed for simultaneous operation. The two jacks are of the same construction. Only one of them is, therefore, shown in FIG. 1 and will hereinafter be described.

The pit 1 has a rear end provided with a pair of transversely spaced apart link supporting shafts 3 and a pair of longitudinal sidewalls each carrying a channel-shaped rail 2 thereon. The two rails 2 extend from the front end of the pit 1 to its middle portion. The open sides of the rails 2 face each other.

The jack installed in the pit 1 includes a pair of vertically stretchable double X-shaped jack components 4 lying in parallel to each other. Each jack component 4 comprises a pair of X-shaped link assemblies one joined to the top of the other. The lower link assembly is formed by a first link **4*a* and a second link 4*b* which are rotatably joined to each other at the mid-portions thereof. The upper link assembly is formed by a third link 4*c* and a fourth link 4*d* which are rotatably joined to each other at the mid-portions thereof. The third link 4*c* has a lower end connected rotatably to the upper end of the first link 4*a*, while the fourth link 4*d* has a lower end connected rotatably to the upper end of the second link 4*b***.

Figure 3:
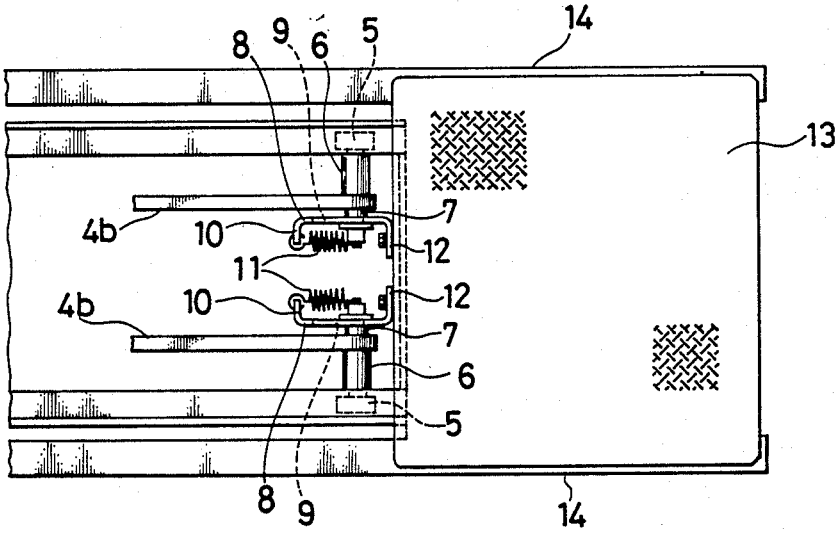
FIG. 3 is a top plan view of FIG. 2.

Each of the first links 4a has a lower end supported rotatably on one of the link supporting shafts 3. Each of the second links 4b has a lower end provided with a roller 5 which is revolvably fitted in one of the rails 2. The lower ends of the second links 4b are, therefore, slidable along the sidewalls of the pit 1, so that the jack components 4 are vertically deformable simultaneously. Each second link 4b is provided at its lower end with a a pin 6 on which the roller 5 is supported, and a pin 7 extending from the pin 6 to an area on the opposite side of the link 4b from the pin 6, as shown in FIG. 3.

Figure 2:
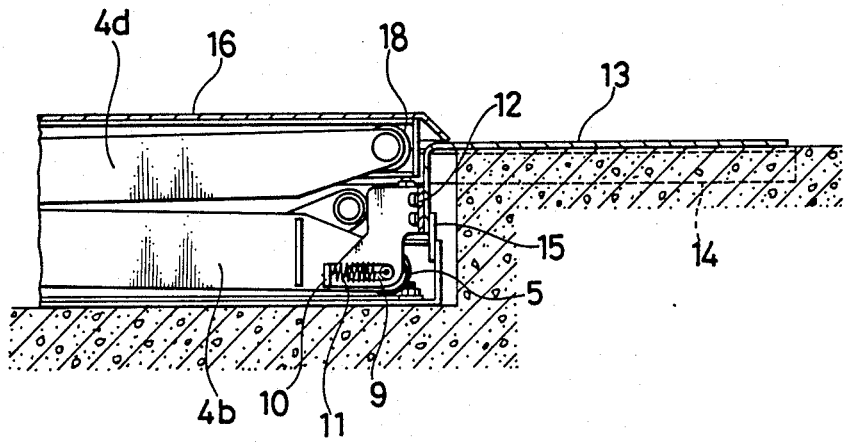
FIG. 2 is a fragmentary enlarged side elevational view of the device showing particularly a part of an automatic pit cover moving mechanism.

The jack is provided with an automatically movable pit cover 13. The pit cover 13 has an L-shaped longitudinal section, as shown in FIG. 2. It has a horizontal portion defining an effective cover portion, and a vertical portion depending from one edge of the horizontal portion and located within the pit 1. A pair of transversely spaced apart slidable brackets 8 each having a channel-shaped cross section are attached to the vertical portion of the pit cover 13 in the transversely middle portion thereof. The concave sides of the brackets 8 face each other, as shown in FIG. 3. Each bracket 8 has a slot 9 elongated in parallel to the rails 2 and one of the pins 7 extends through the slot 9. Each bracket 8 has a front end 12 secured to the vertical portion of the pit cover 13. A spring 11 is connected between each pin 7 and the rear end 10 of the corresponding bracket 8.

The pit cover 13 is so sized as to be capable of closing the whole area of the pit 1 which is opened when the second links 4b are moved to stretch the jack components 4, while causing the rollers 5 to arrive at the rear ends of the rails 2 which are located in the middle portion of the pit. In other words, the pit cover 13 can close the open area extending from the front end of the pit 1 to the lower ends of the second links 4b, substantially as shown in FIG. 1.

The pit cover 13 is slidable on and along a pair of parallel angle bars 14 disposed along the sidewalls, respectively, of the pit 1 and extending beyond the front end of the pit 1. Each angle bar 14 is embedded in the floor in which the pit 1 is made, and has a top surface which is flush with the floor surface. The front end wall of the pit 1 is provided with a stop member 15 defining a limit to the returning motion of the pit cover 13.

A horizontal table 16 is supported on the upper ends of the jack components 4 for lifting and supporting a motor vehicle thereon. Each third link 4c has an upper end supported rotatably on the underside of the table 16 adjacent to the rear end thereof. The table 16 is provided on the underside thereof with a pair of transversely spaced apart rails 17 each having a channel-shaped cross section and extending partly along one of a pair of longitudinal edges of the table 16. Each fourth link 4d has an upper end provided with a roller 18 which is revolvably fitted in one of the rails 17. A horizontal connecting rod 19 extends between the fourth links 4d slightly below the upper ends thereof and thereby connects the two jack components 4 to each other.

The jack also includes a hydraulic cylinder 20 provided between the jack components 4 in parallel thereto for stretching and folding them. It has a lower end supported rotatably on a shaft provided on the rear end wall of the pit 1 between the link supporting shafts 3 co-axially therewith. It includes a piston rod 21 having an outer end supported rotatably on the connecting rod 19 at the mid-portion thereof. The jack further includes a pawl and rack mechanism provided along the cylinder 20 for holding the table 16 in a raised position.

Figure 4:
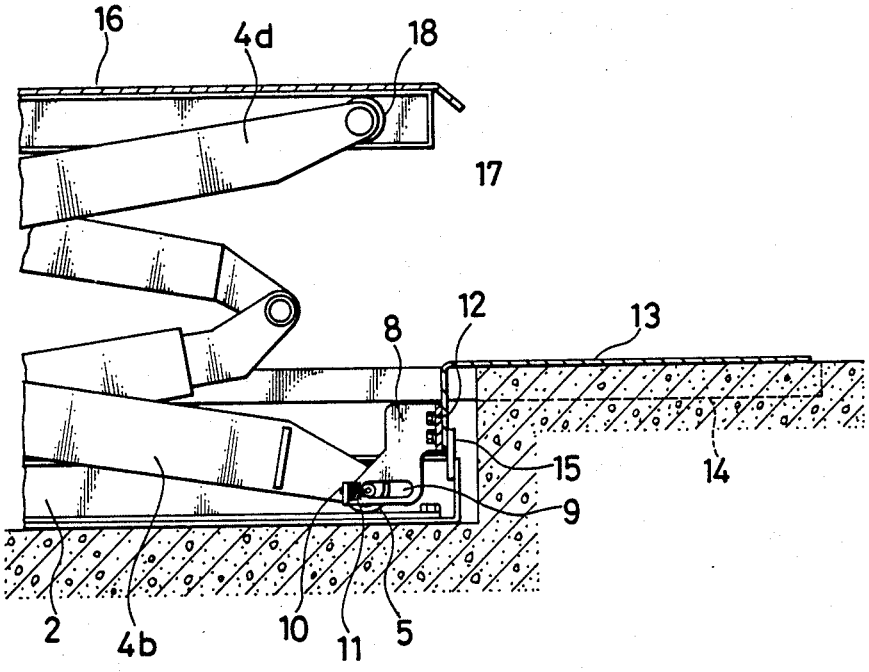
FIG. 4 is a view similar to FIG. 2, but showing the mechanism when a table has been raised to a certain level of height.

If the cylinder 20 is supplied with a hydraulic fluid, the piston rod 21 gradually extends upwardly and raises the rod 19. All of the links 4a to 4d are, therefore, raised, while the rollers 5 are caused by the rising second links 4b to move along the rails 2 toward the inner ends thereof, whereby the table 16 is gradually raised. The brackets 8 and therefore the pit cover 13 stay at a standstill until the table 16 is raised to a certain level of height (say, 400 mm) above the floor, as the pins 7 move with the pins 6 carrying the rollers 5 along the slots 9 by overcoming the actions of the springs 11. Compare FIG. 4 with FIGS. 2 and 3. When the table 16 has been raised to a certain level of height as shown in FIGURE 4, the pins 7 stay close to the inner extremities of the slots 9 after they have compressed the springs 11 completely, and can no longer move without pulling the brackets 8. As the table 16 is further raised, therefore, the brackets 8 are also moved to thereby move the pit cover 13 until it closes the open area of the pit 1, as hereinbefore described.

When the table 16 is lowered, the sequence of the movements which have hereinabove been described is reversed. The pins 7 and the brackets 8 move back together with the pins 6 until the table 16 is lowered to such a level of height as is shown in FIG. 4. When the table 16 has been lowered to that position, however, the vertical portion of the pit cover 13 abuts on the stop member 15 and the stop member 15 does not permit any further retraction of the brackets 8 or the pit cover 13. Therefore, only the pins 7 thereafter move back by overcoming the actions of the springs 11 and stretching them until they abut on the outer extremities of the slots 9. As a result, the jack components 4, etc. are folded down in the pit 1 and the pit 1 is closed by the table 16, as shown in FIGURE 2.

The absence of any motion of the brackets 8 and the pit cover 13, which is due to the presence of the slots 9, exists during the beginning of elevation of the table 16 and toward the end of its lowering, as is obvious from the foregoing description. This absence of movement is necessary or desirable for preventing any possible interference of the cargo on the table 16 with the pit cover 13, or vice versa.

Although the invention has been described with reference to a hijacking device comprising double X-shaped jack components, it is also useful for a wide variety of other applications, including not only a jacking device comprising single X-shaped jack components, but also a twin lifting device which is adapted for installation in a pit and movement therein.

Although the hydraulic cylinder has been described as being disposed between the jack components in parallel thereto, it is also possible to install it in any other position or way if it can properly raise and lower the table. It is also possible to substitute therefore any other appropriate mechanism, such as one comprising an electric motor and a chain.

Although the pins associating the pit cover operationally with the links have been described as being fitted in the slots of the slidable brackets, it is also possible to connect the brackets directly to the lower ends of the second links.

What is claimed is:

1. In a jacking device including at least one jack installed in a floor pit, said jack comprising at least two horizontally spaced apart parallel pairs of links which are designed for simultaneous movement in two parallel vertical planes, respectively, a mechanism associated with said links for moving them in said planes, and a table supported horizontally on said links, each of said pairs of links consisting of a first link and a second link which are so connected to each other as to form an X-shaped assembly when they are raised to raise said table, said first links which said pairs of links include being parallel to each other, while said second links are also parallel to each other, said links and said mechanism being foldable into said pit when said table is lowered to close said pit, the improvement which comprises:

each of said second links having a lower end supported in said pit slidably along one of a pair of sidewalls of said pit, while each of said first links has a lower end supported rotatably in said pit at one end thereof;

a horizontal pit cover connected to said second links slidably therewith for closing said pit which is opened when said table is raised; and a mechanism connecting said cover to said second links for causing said cover to slide with said second links.

2. A jacking device as set forth in claim 1, wherein said connecting mechanism comprises:

a pair of horizontally spaced apart parallel slidable brackets secured to said cover and each having a slot which is horizontally elongated in parallel to said sidewalls; and a pin projecting from said lower end of each of said second links and received slidably in said slot.

3. A jacking device as set forth in claim 2, further including a pair of springs each connected between one of said brackets and said pin projecting from one of said second links and lying in parallel to said slot of said one bracket for urging said pin toward one end of said slot to hold said cover out of sliding motion during a part of the sliding motion of said second links.

4. A jacking device as set forth in claim 3, wherein said cover includes a horizontal portion having an edge extending above said pit at right angles to said sidewalls thereof, and a vertical portion depending from said edge and staying in said pit, said brackets being secured to said vertical portion.

5. A jacking device as set forth in claim 4, further including a pair of horizontally spaced apart parallel angle bars provided along said sidewalls, respectively, for supporting said cover slidably thereon, each of said bars having a top surface flush with the surface of the floor in which said pit is made.

* * * * *